US006899663B2

(12) United States Patent
Tetenborg

(10) Patent No.: US 6,899,663 B2
(45) Date of Patent: May 31, 2005

(54) METHOD FOR PRODUCING LOOP HANDLE SHOPPING BAGS

(75) Inventor: Konrad Tetenborg, Lengerich (DE)

(73) Assignee: Windmoeller & Hoelscher KG, Lengerich (DE)

( * ) Notice: Subject to any disclaimer, the term of this patent is extended or adjusted under 35 U.S.C. 154(b) by 25 days.

(21) Appl. No.: 10/222,986

(22) Filed: Aug. 19, 2002

(65) Prior Publication Data

US 2004/0032993 A1 Feb. 19, 2004

(51) Int. Cl.[7] ..... B31B 1/62
(52) U.S. Cl. ..... 493/221; 493/226
(58) Field of Search ..... 493/221, 226, 493/409, 926

(56) References Cited

U.S. PATENT DOCUMENTS

| | | | | | |
|---|---|---|---|---|---|
| 3,486,421 | A | * | 12/1969 | Franson | 493/221 |
| 3,507,194 | A | * | 4/1970 | Schwarzkopf | 493/196 |
| 4,362,526 | A | * | 12/1982 | Wilson | 493/226 |
| 4,510,620 | A | * | 4/1985 | Langen et al. | 383/14 |
| 5,069,659 | A | * | 12/1991 | Bochtler et al. | 493/194 |
| 5,356,221 | A | * | 10/1994 | Achelpohl et al. | 383/21 |
| 5,378,220 | A | * | 1/1995 | Bunn | 493/226 |
| 5,382,215 | A | * | 1/1995 | Mattiebe | 493/221 |
| 5,421,805 | A | * | 6/1995 | Baxter et al. | 493/226 |
| 6,059,709 | A | * | 5/2000 | Achelpohl et al. | 493/226 |

FOREIGN PATENT DOCUMENTS

| | | |
|---|---|---|
| DE | 2 012 084 | 9/1971 |
| DE | 2 225 671 | 7/1973 |
| DE | 195 02 228 | 5/1996 |
| DE | 197 48 771 | 5/1999 |
| DE | 199 24 626 | 12/2000 |

* cited by examiner

*Primary Examiner*—Eugene Kim
(74) *Attorney, Agent, or Firm*—Jacobson Holman PLLC

(57) ABSTRACT

For the production of loop handle shopping bags based on semi-tube sheeting consisting of thermoplastic plastic, an edge strip of the semi-tube sheeting is folded onto itself and reinforcement warps, consisting of a weld-friendly thermoplastic plastic that provides a good weld, are attached on the interior sides of the edge areas by means of glueing or welding at a distance corresponding to the width of the shopping bags to be produced.

Subsequently, the edge strip is folded back so that the added reinforcement warps are positioned back-to-back. Double-layer handle strips are positioned in a U-shape and placed between the reinforcement warps with their end areas of the free shanks, and welded together with the edge areas through the reinforcement warps between welding devices. The shopping bags are then separated from the semi-tube sheeting by means of separating weld seams.

18 Claims, 3 Drawing Sheets

METHOD FOR PRODUCING LOOP HANDLE SHOPPING BAGS

BACKGROUND OF THE INVENTION

1. Field of the Invention

The invention relates to a method for producing loop handle shopping bags based on a tube sheeting consisting of thermoplastic plastic that is preferably equipped with a bottom fold.

2. Description of the Related Art

Methods of this type are known.

In a method for producing loop handle shopping bags consisting of thermoplastic plastic known from DE 197 48 771 A1, the carrying handles embodied as handle loops are folded toward the interior and connected to the respective side wall on the edge areas of the bag side walls by means of welding or glueing.

In a method for producing loop handle shopping bags from a continuous feed double-layer thermoplastic plastic foil sheeting known from DE 99 24 626 A1, its edge areas are folded over by 180° on one side for attaching the shanks of the handle strips, and folded back congruently after attaching the handle strips. These known methods for producing loop handle shopping bags require that the edge areas of the shopping bags must be folded over for the reinforcement of the edges, which causes an increased consumption of plastic foil.

The shaping of U-shaped loop handles from a strip separated from plastic sheeting is known, for instance, from DE 20 12 084 A1 and DE 22 25 671 A1.

SUMMARY OF THE INVENTION

It is the task of the invention to recommend a method according to which loop handle shopping bags can be produced in a simple and cost-effective manner.

According to the invention, this task is solved by a method for producing shopping bags based on a semi-tube sheeting of thermoplastic plastic that is preferably equipped with a bottom fold. At least one edge strip of the semi-tube sheeting, which consits of weld-friendly plastic, is folded onto itself and attached to reinforcement warps on the interior sides of the edge areas by means of gluing or welding. At least the one edge strip is folded back so that the added reinforcement warps are congruently positioned back to back. Double-layer handle strips, that are preferably equipped with at least one layer preventing a weld between their back-to-back sides, or into which a plate, such as a separating plate, is inserted during welding, are positioned in a U-shape, and positioned with their end areas between the reinforcement warps and welded together with edge areas between weld devices through the reinforcement warps. The shopping bags are separated from the semi-tube sheeting by means of separating weld seams, or weld seams and separating cuts.

The inventive method can be performed in a material-saving manner, as the edge or hem fold can be omitted. The glued on, or welded on reinforcement warp can be freely chosen in its thickness and foil composition. It consists of a very weld-friendly warp foil that leads to a shorter welding time of the handle loop, and therefore to an increased production performance. The loop handle shopping bag produced according to the inventive method has a good appearance, because an existing imprint is not interrupted by a weld seam, and no wrinkling occurs due to the shrinking of the weld seams.

The formation of loop handles consisting of plastic strips that are positioned back-to-back, and the welding on of the reinforcement warp onto the interior sides of the plastic semi-tube sheeting edges can also be performed according to the description provided in DE 195 02 228 A1. Instead of a plate or a separating plate, a heatable crimper may also be inserted as an abutment between the welding areas of the loop handle shanks.

The invention further relates to shopping bags that have been produced according to the inventive method.

BRIEF DESCRIPTION OF THE DRAWINGS

An embodiment example of the invention is described in further detail according to the drawing as follows. It shows FIG. 1 a side view of the handle area of a loop handle shopping bag produced according to the inventive method, FIG. 2 a section through the welding area of two loop handle shanks that are positioned on top of each other along the line II—II in FIG. 1, FIG. 3 a sketched illustration of the inventive production method, and FIGS. 4*a–f* the separate steps of the inventive method for producing loop handle shopping bags in the shape of cross sections through the foil sheeting, semi-tube sheeting, and loop handle shopping bag according to FIG. 3.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 3:
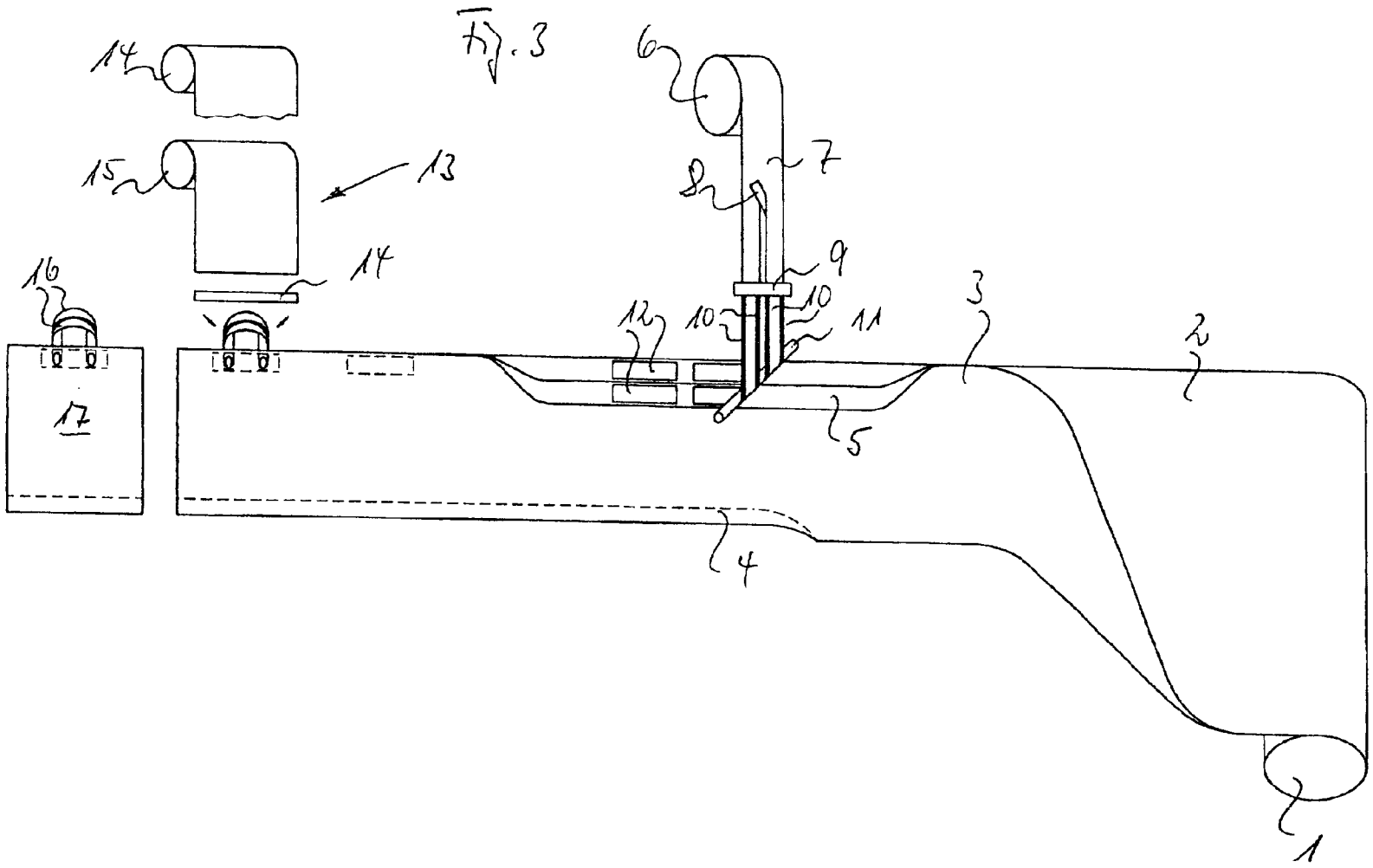
Figure 4:
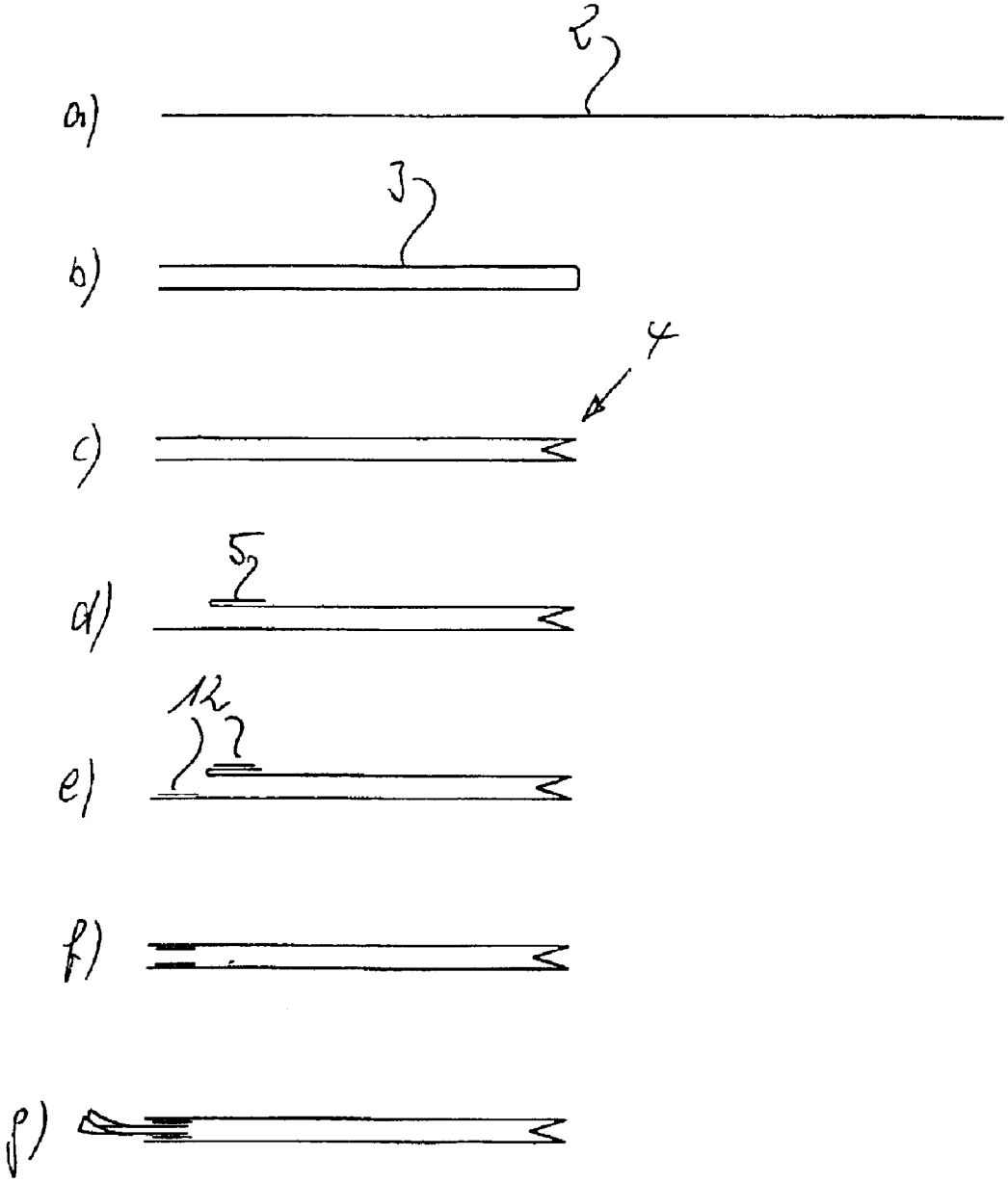

Based on FIG. 3 and FIG. 4, a flat foil sheeting 2 consisting of thermoplastic plastic is pulled off of a not illustrated foil roll 1 held by an unwind rack by means of not illustrated pull-off devices. This flat foil sheeting is illustrated in FIG. 4*a* in a cross section.

This flat foil sheeting is then folded in the center into the shape of a semi-tube sheeting 3 by means of a not illustrated, known device, as is shown in a sectional view in FIG. 4*b*. In a subsequent processing station, a bottom fold 4 is placed into this semi-tube sheeting, as is shown in FIG. 4*c*. The edge area 5 of the upper layer is then folded back onto itself, as is shown in FIG. 4*d* from the semi-tube sheeting that is continuously or intermittently pulled forward so that the interior edge areas of the semi-tube sheeting are exposed.

A plastic sheeting 7 is pulled off of the foil roll 6 consisting of weld-friendly thermoplastic plastic in the manner shown in FIG. 3, which is separated by means of a separating knife 8 into two equally wide sheets that are positioned on one level. Both of these sheets are equipped with adhesive applications 10, such as hot melt applications, at their edges in a station 9. The sheets glued in this way are then redirected via a rod 11 onto the level of the exposed edge areas. The reinforcement warps 12 are then separated in pairs from the glued sheets in a manner shown in FIG. 4*e* and pressed onto the exposed interior edge areas of the semi-tube sheeting, each at a distance corresponding to the width of the loop handle shopping bags to be produced. After the reinforcement warps have been glued onto the interior edge areas of the semi-tube sheeting, the upper edge area 5 is folded back as shown in FIG. 4*f* so that the reinforcement warps are congruently placed back-to-back, each in the center of the loop handle shopping bags that will be separated later.

In station 13, plastic sheeting is removed from two rolls 14, 15 consisting of thermoplastic plastic that are positioned behind each other, from which handle strips 14 that are positioned back-to-back are separated. These handle strips 14 are shaped into U-shaped loop handles 16 as they are positioned back-to-back. The free ends of these loop handles are then inserted between the reinforcement warps 12 that are positioned back-to-back, and welded together with the reinforcement warps, and above the same with the edge areas of the semi-tube sheeting 3 by means of weld seams, preferably O-shaped weld seams.

Figure 1:
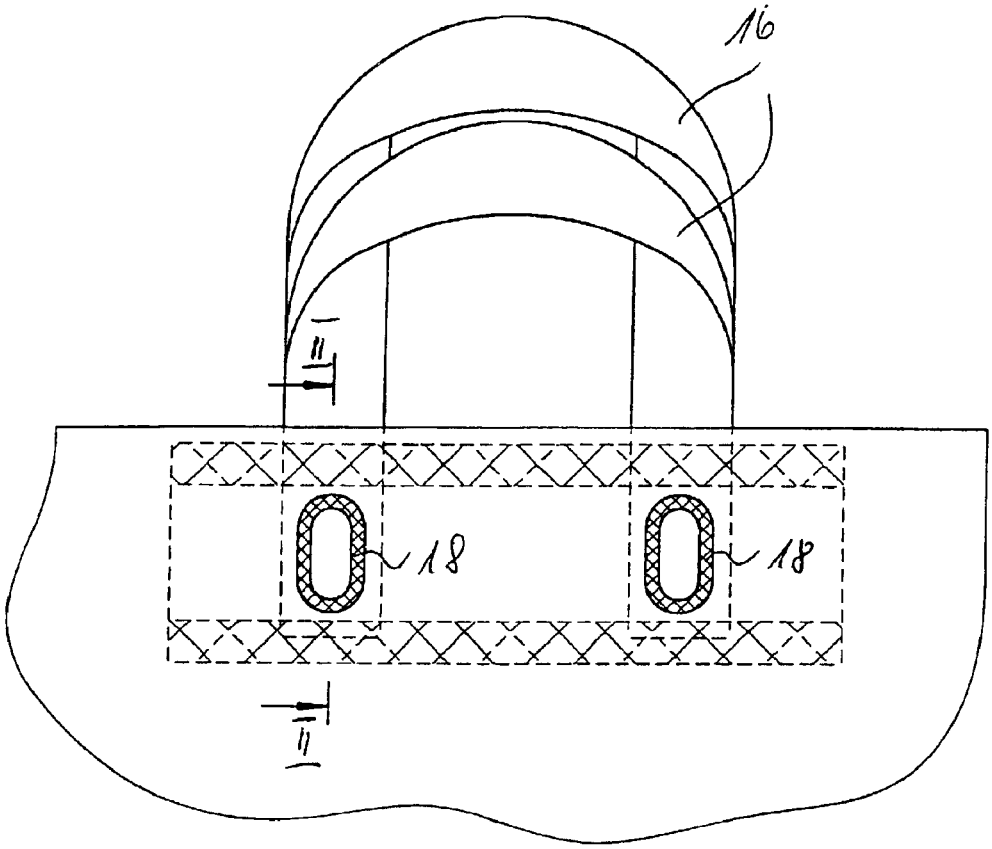
Figure 2:
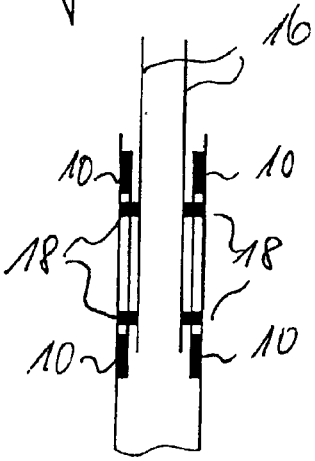

The finished loop handle bags 17 are then weld-separated from the semi-tube sheeting connected by loop handles by means of lateral weld separating seams in the described manner. The preferably O-shaped weld seams 18 are performed in the manner shown in FIG. 2 so that they will connect the free ends of the loop handle 16 shanks with the edge areas of the semi-tube sheeting by interpositioning the reinforcement warps 12 consisting of a particularly weld-friendly material. However, the welding of the loop handles with the warps only can also be sufficient.

In order to avoid a welding of the back-to-back positioned loop handle shanks with each other, they are equipped with a separating layer, or a separating plate, or a heatable crimper embodied as an abutment is inserted between them during welding.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A method for producing loop handle shopping bags based on semi-tube sheeting of thermoplastic plastic having two edge strips, comprising the steps of:

folding at least one edge strip of the semi-tube sheeting onto itself to expose interior sides of said edge strips;

attaching a reinforcement warp made of weld-friendly plastic to each of said interior sides;

unfolding said at least one edge strip so that the attached reinforcement warps are congruently positioned back-to-back;

positioning double-layer handle strips in a U-shape with free ends of said strips positioned between said reinforcement warps, and welding said free ends to said reinforcement warps to form a loop handle; and separating a portion of said semi-tube sheeting having said loop handle to form a shopping bag.

2. The method as set forth in claim 1, wherein said step of attaching includes gluing.

3. The method as set forth in claim 1, wherein said step of attaching includes welding.

4. The method as set forth in claim 1, wherein weld zones where said handle is welded remain free of adhesive during the step of attaching the reinforcement warp.

5. The method as set forth in claim 1, wherein the handle strips are welded both with said reinforcement warps and with edge areas of said edge strips.

6. The method as set forth in claim 5, wherein the welding of the handle strips with the edge areas occurs through said reinforcement warps.

7. The method as set forth in claim 1, wherein said step of separating includes using weld seams.

8. The method as set forth in claim 7, wherein said step of separating further includes separating cuts.

9. The method as set forth in claim 1, wherein two loop handles are welded to said semi-tube sheeting, said two handles being positioned back-to-back when attached to corresponding reinforcement warps, a separating layer being placed between said back-to-back loop handles during the step of welding said free ends to avoid welding the handles to each other.

10. A method for producing loop handle shopping bags of thermoplastic plastic sheeting, comprising the steps of:

folding said thermoplastic plastic sheeting along a center line to form a semi-tube shape having an upper layer and a lower layer of sheeting;

folding an edge strip of the upper layer of sheeting onto itself to expose a first interior side of said edge strip of the upper layer as well as a second interior side of an edge strip of said lower layer;

attaching a reinforcement warp made of weld-friendly plastic to each of said first and second interior sides;

unfolding said edge strip of the upper layer so that the reinforcement warps attached to the first and second interior sides are congruently positioned back-to-back;

positioning double-layer handle strips in a U-shape with free ends of said strips positioned between said reinforcement warps;

welding the free ends of a first handle strip to the reinforcement warp attached to said first interior side, and welding the free ends of a second handle strip to the reinforcement warp attached to said second interior side, forming a loop handle with said first and second handle strips; and separating a portion of said semi-tube sheeting having said loop handle to form a shopping bag.

11. The method as set forth in claim 10, wherein said step of attaching includes gluing.

12. The method as set forth in claim 10, wherein said step of attaching includes welding.

13. The method as set forth in claim 10, wherein weld zones where said handle strips are welded remain free of adhesive during the step of attaching the reinforcement warps.

14. The method as set forth in claim 10, wherein the handle strips are welded both with said reinforcement warps and with edge areas of said edge strips.

15. The method as set forth in claim 14, wherein the welding of the handle strips with the edge areas occurs through said reinforcement warps.

16. The method as set forth in claim 10, wherein said step of separating includes using weld seams.

17. The method as set forth in claim 16, wherein said step of separating further includes separating cuts.

18. The method as set forth in claim 10, wherein when said first and second handle strips are attached to corresponding reinforcement warps, a separating layer is placed therebetween during the step of welding said free ends to avoid welding the handle strips to each other.

* * * * *